US006237508B1

(12) United States Patent
Weiss

(10) Patent No.: US 6,237,508 B1
(45) Date of Patent: May 29, 2001

(54) STAND CONVERTIBLE TO A TABLE OR DECORATIVE CONTAINER

(75) Inventor: Jeffry Weiss, McMurray, PA (US)

(73) Assignee: Diversified Overseas Marketing, Inc., Coraopolis, PA (US)

( * ) Notice: Subject to any disclaimer, the term of this patent is extended or adjusted under 35 U.S.C. 154(b) by 0 days.

(21) Appl. No.: 09/417,422

(22) Filed: Oct. 13, 1999

Related U.S. Application Data

(63) Continuation-in-part of application No. 29/090,718, filed on Sep. 18, 1998, now Pat. No. Des. 416,689.

(51) Int. Cl.[7] ..... A47B 85/00
(52) U.S. Cl. ..... 108/26
(58) Field of Search ..... 108/25, 26, 26.2, 108/150, 24, 90, 13, 14

(56) References Cited

U.S. PATENT DOCUMENTS

| | | | | |
|---|---|---|---|---|
| D. 232,877 | | 9/1974 | Kephart . | |
| D. 380,318 | | 7/1997 | Horvath . | |
| 1,422,613 | | 7/1922 | Ogden . | |
| 1,850,420 | * | 3/1932 | Schuldt | 108/13 X |
| 2,197,992 | | 4/1940 | Baxter . | |
| 2,508,802 | * | 5/1950 | Schade | 108/26 X |
| 2,683,639 | * | 7/1954 | Brenny | 108/26 X |
| 5,055,081 | * | 10/1991 | Nayak | 108/26 X |
| 5,060,580 | * | 10/1991 | Shaw | 108/25 |
| 5,218,912 | * | 6/1993 | Buske | 108/14 X |
| 5,718,178 | | 2/1998 | Smith . | |
| 5,778,800 | * | 7/1998 | Liang | 108/26 X |

FOREIGN PATENT DOCUMENTS

| | | | | |
|---|---|---|---|---|
| 447515 | * | 3/1968 | (CH) | 108/14 |

* cited by examiner

*Primary Examiner*—Jose V. Chen
(74) *Attorney, Agent, or Firm*—David C. Jenkins; Arnold B. Silverman; Eckert Seamans Cherin & Mellott, LLC

(57) ABSTRACT

A stand with a planar table top and an opening therethrough is provided. A plurality of leg members extend below the table top. The stand also includes a removable table top disposed within the opening such that the upper surface of the table top insert is generally planar with the upper surface of the table top. To convert the stand to a decorative container, the table top insert is removed and a container is lowered through the opening until it is positioned where the table top insert was located.

13 Claims, 14 Drawing Sheets

STAND CONVERTIBLE TO A TABLE OR DECORATIVE CONTAINER

This application is a Continuation-In-Part of application Ser. No. 29/090,718, filed Sep. 18, 1998 now Des. Pat. No. 416,689.

BACKGROUND OF THE INVENTION

1. Field of the Invention

The present invention relates to furniture. More specifically to a stand which can be converted from a table or to a decorative container and vice versa. The stand is equipped with an elevated support surface with an opening therethrough which supports either a table top insert or a multi-purpose decorative container.

2. Background Information

Utility tables for elevating small objects, such as flowerpots, are well known in the prior art. However, the simple utility table may be improved on by to incorporating an easily accessible container, which may be used to hold decorative objects such as a flowerpot, artificial flowers, bulbs, a candle, or which may be used as a fish bowl or planter itself.

The value of a simple utility table cannot be understated. However, when used as a surface for elevating flowerpots and other such devices, the typical table has certain disadvantages. For example, if a flowerpot is on a table and dirt or water is spilled therefrom, the table will not contain water or dirt and such dirt and water may further spill onto the floor. Additionally, flowerpots placed on top of a table surface may be knocked off when the table is jostled or upset. Finally, some people may find the appearance of a flowerpot to be aesthetically displeasing. The same holds true for other objects. For example, a candle is subject to being knocked off a table when jostled and may spill hot wax onto the table top and floor. Therefore, there is a need for a piece of furniture that can be used as a table when a table is needed, while being convertible to a decorative container.

Equally well known in the prior art are planters; a container for holding soil and any variety of plants or flowers. Planters may be elevated, by legs, for example, so that a person does not have to bend over or kneel while tending the plant. Also, an elevated planter may lift the plant into proximity to a window or other source of light. Such planters are useful and attractive during the period the plant in the planter is blooming. However, some plants become dormant for extended periods of time. During the period of plant dormancy, the planter is of limited use. For example, because a planter contains dirt, it may not be useful as support for objects one does not wish to soil. Additionally, the planter may not be movable, depending on their size and the weight of the soil held in therein. Thus, planters can be subject to periods of limited use. Finally, if one had a stand supporting a container holding any decorative article, such as artificial flowers or a candle, one may desire to quickly convert such a stand into a utility table. Therefore, there is a need for a piece of furniture that can be used as a decorative display container or planter as needed, while being convertible into a table as needed.

Accordingly, it is desirable to have a stand which is convertible between a table and a multi-purpose decorative container or urn so that a single piece of furniture could be used as either.

SUMMARY OF THE INVENTION

The above described needs have been met by the present invention. The present invention provides for a stand having a removable table top insert which may be replaced with a container suitable for holding a decorative device, such as a flowerpot, or as a planter itself. The stand has a table top with an opening in which the table top insert will typically rest. When the user desires to convert the stand into a planter or urn, the table top insert is simply removed and the planter or container is placed through the opening. The table top has a means to support the table top insert, and/or the planter or the container, extending into the opening. The support means may be individual elements, such as pins, extending from adjacent to the underside of the table top into the opening or a flange extending around the entire perimeter of the opening. The table top insert may include separate portions, e.g. a semi-circle or a central disk and an annular disk.

The invention may also be practiced as a stand without a continuous table top. In this embodiment of the stand, the legs are maintained in position by a brace near the bottom of the legs. The upper surface of the legs terminate in generally planar surfaces which define an interior space. Extending from the planar surfaces are support elements, such as pins, which extend into the interior space. The table top insert may be placed between the legs, resting on the elements in the interior space. The stand can be converted to a decorative display container by removing the table top insert and inserting a planter or container which will rest upon the planar surfaces or on the pins which protrude into the interior space.

A second alternate embodiment incorporates the features traditionally associated with an urn. That is, a pedestal base which supports a bowl shaped body. As with the first embodiment, the urn shaped table has a table top and a medial opening therethrough. The table top has a means to support the table top insert, and/or the planter or the container, extending into the opening. The support means may be individual elements, such as pins, extending from adjacent to the underside of the table top into the opening or a flange extending around the entire perimeter of the opening.

In each embodiment the container is installed substantially below the table top, any water or dirt spilled on the table top may be easily swept into the container. Further, because the decorative display container is within the opening of the stand, any object in the container is less likely to be knocked over than an object resting on a table when jostled.

It is an object of this invention to provide a stand which is convertible from a table to a multi-purpose decorative container.

It is a further object of this invention to provide a stand which converts from a table to a decorative container without the use of tools.

It is a further object of this invention to provide a stand that may be used as a table while having a visible container.

It is a further object of this invention to provide a stand which is convertible from a table into a planter and vice versa.

It is a further object of this invention to provide a stand capable of supporting a flowerpot or a planter that will reduce the chance for damage to the flowerpot when the stand is jostled or upset.

It is a further object of this invention to provide a stand that, when used as a planter, may be converted into a table without requiring the removal of soil from the planter.

These and other objects of the invention will be more fully understood from the following description of the invention in reference to the illustrations appended hereto.

DESCRIPTION OF THE PREFERRED EMBODIMENT

As employed herein, the term "medial opening" does not require the opening to be in the precise middle of the upper portion.

Figure 1:
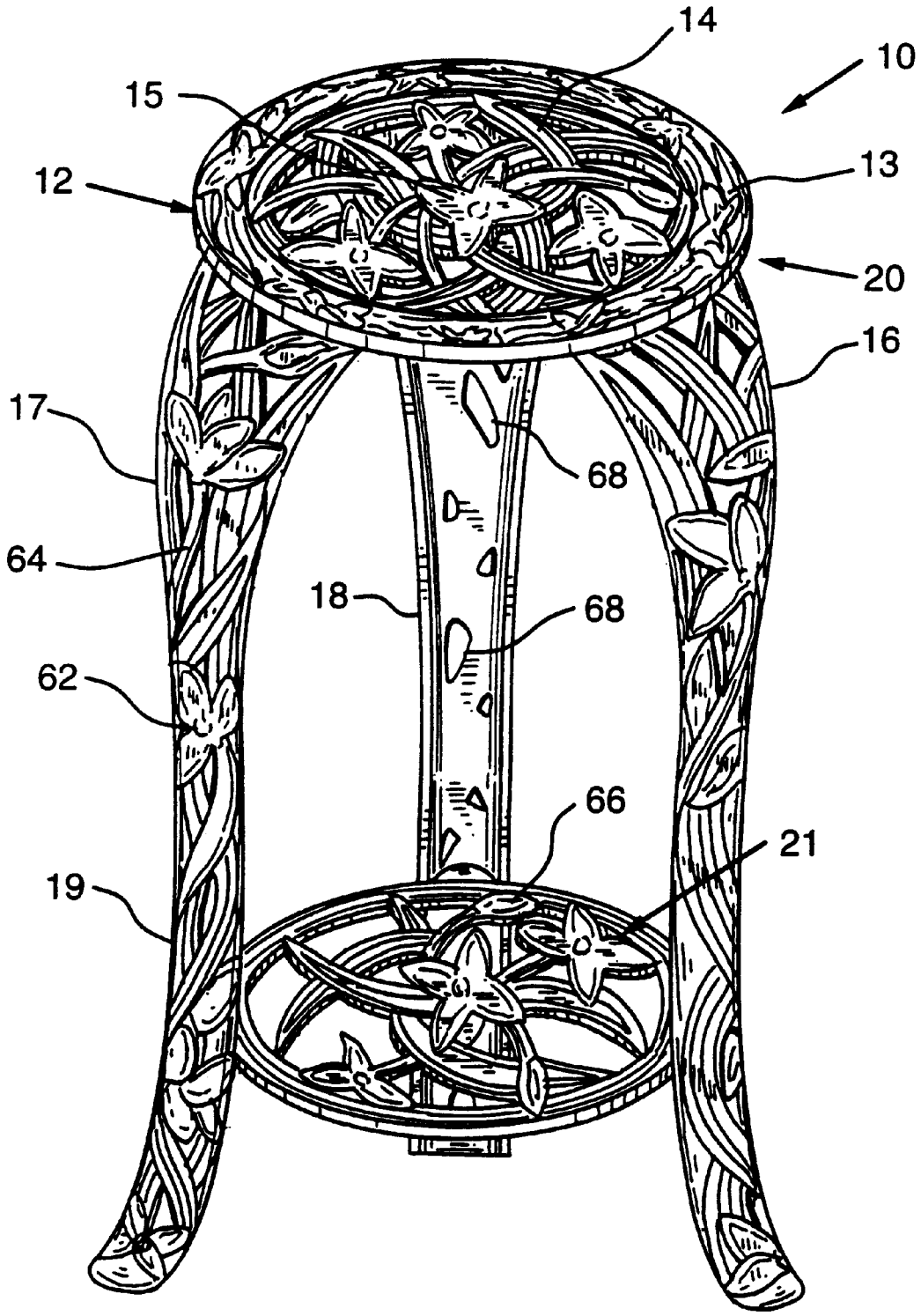
FIG. 1 is a perspective view of the stand shown with the table top inset in place.
Figure 2:
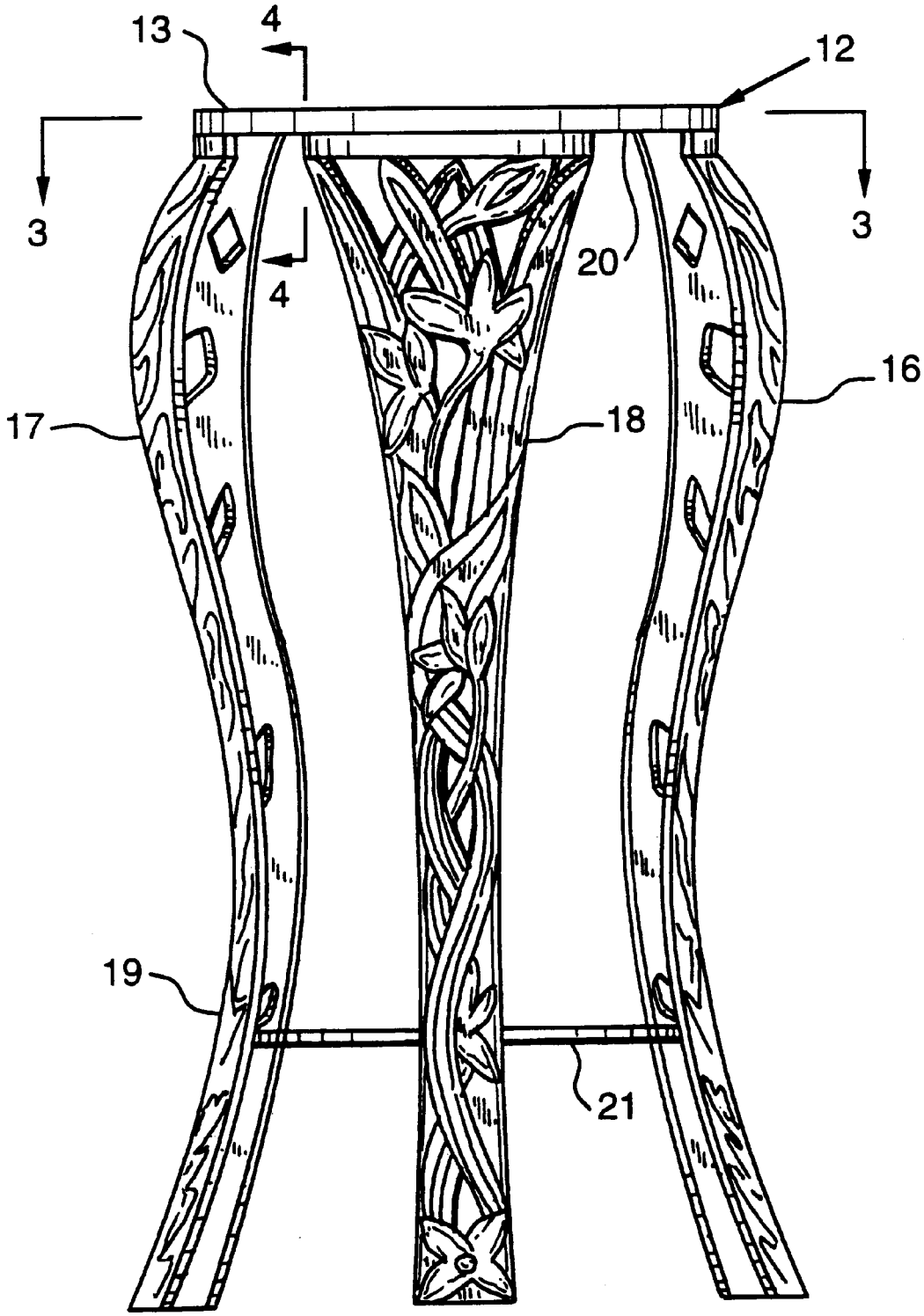
FIG. 2 is an elevational view showing the stand.
Figure 5:
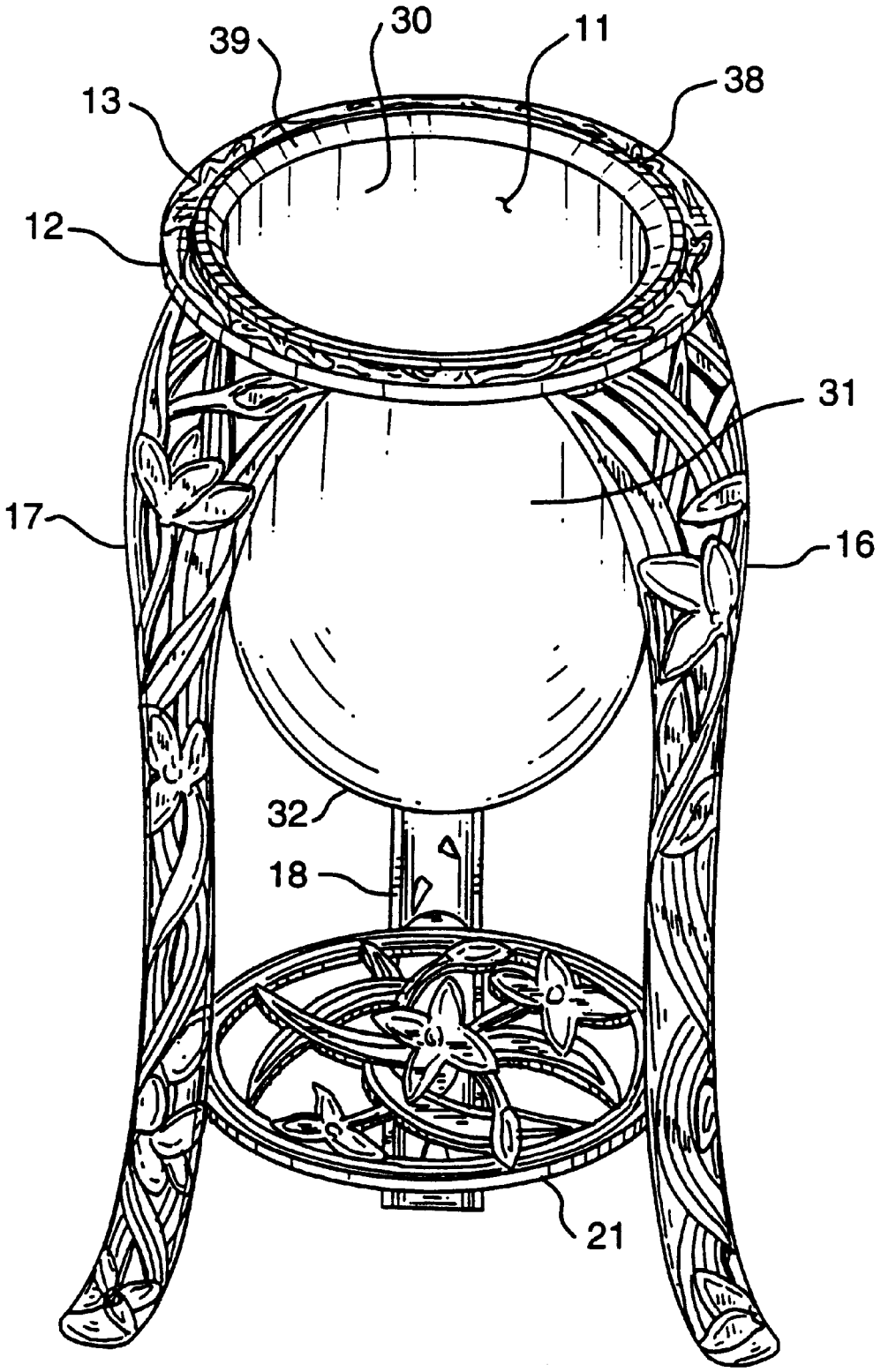
FIG. 5 is a perspective view of the stand with the container inserted.

FIGS. 1, 2 and 5 show a stand 10 that is convertible into a multi-purpose decorative display container according to the present invention. The stand 10 embodies, a table top 12, having an upper surface 13, and a lower surface 20 (shown on FIG. 2), a table top insert 14, a table top insert upper surface 15, and a plurality of leg members 16, 17 and 18. The table top 12 has a medial opening 11 (shown on FIG. 5). The removable table top insert 14 is sized to fit within the opening 11, so that the table top 12 and the table top insert 16 form a generally continuous surface.

Figure 11:
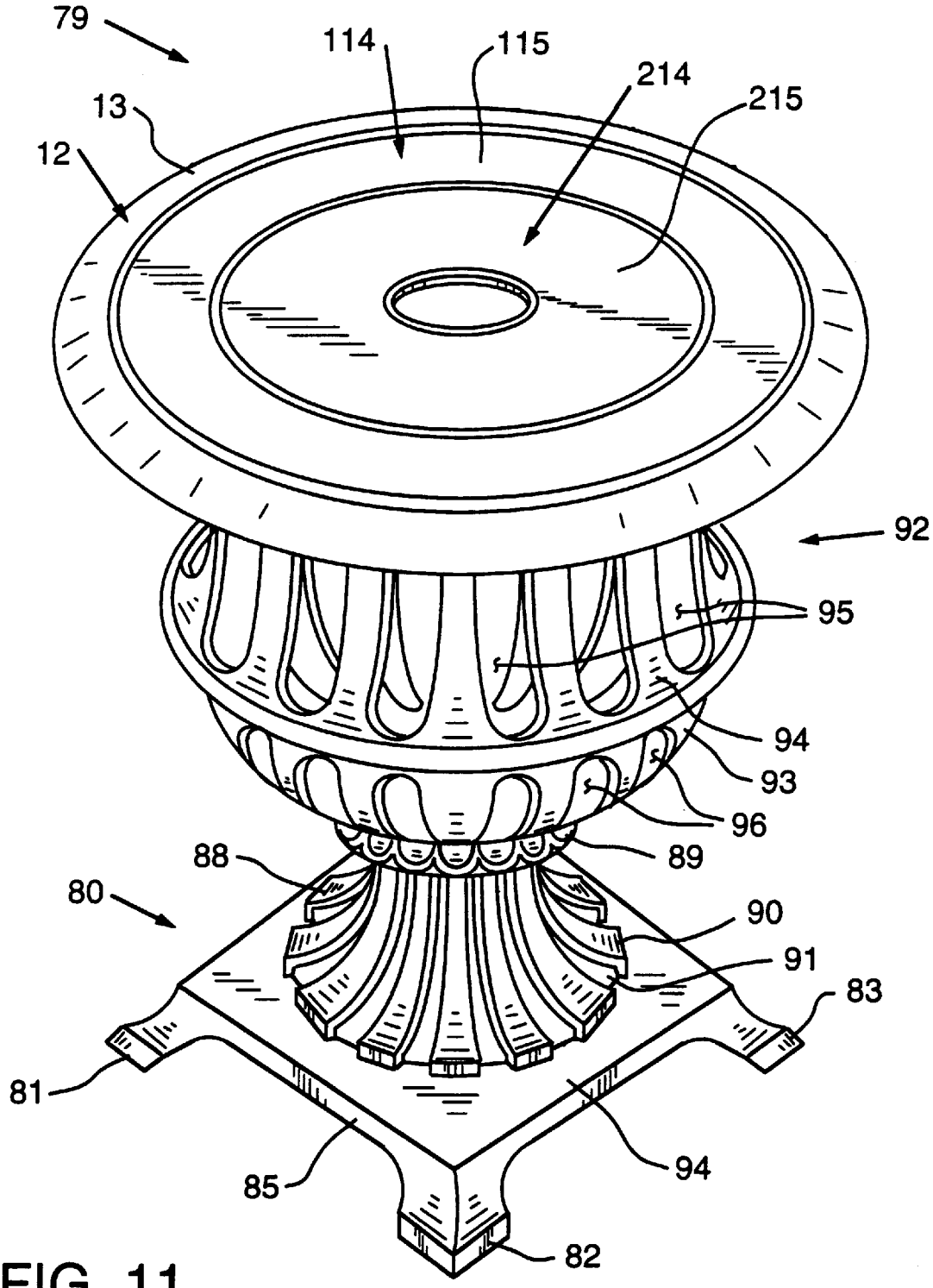
FIG. 11 is a perspective view of an alternate embodiment.
Figure 12:
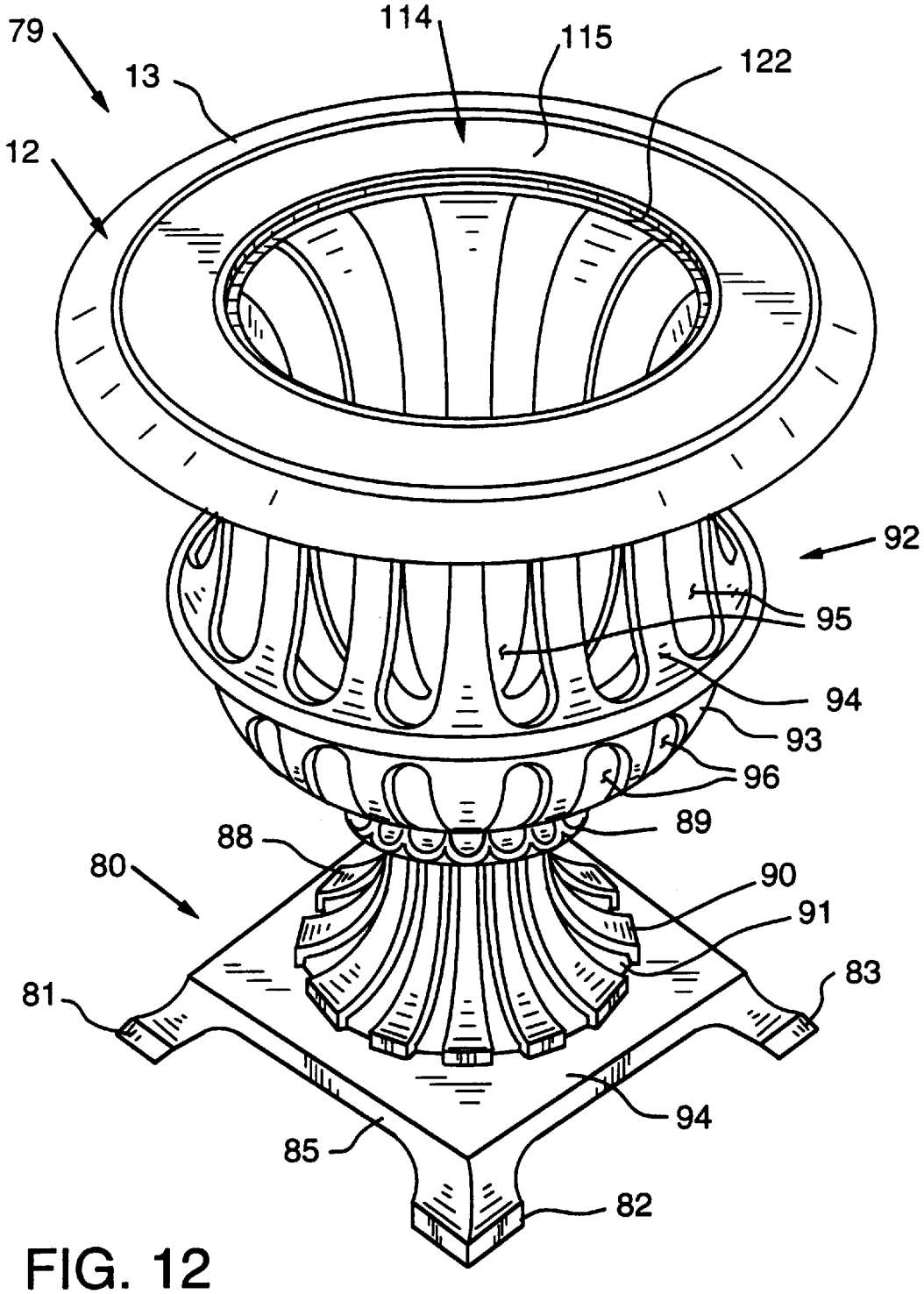
FIG. 12 is a perspective view of an alternate embodiment having a portion of the table top insert removed.
Figure 13:
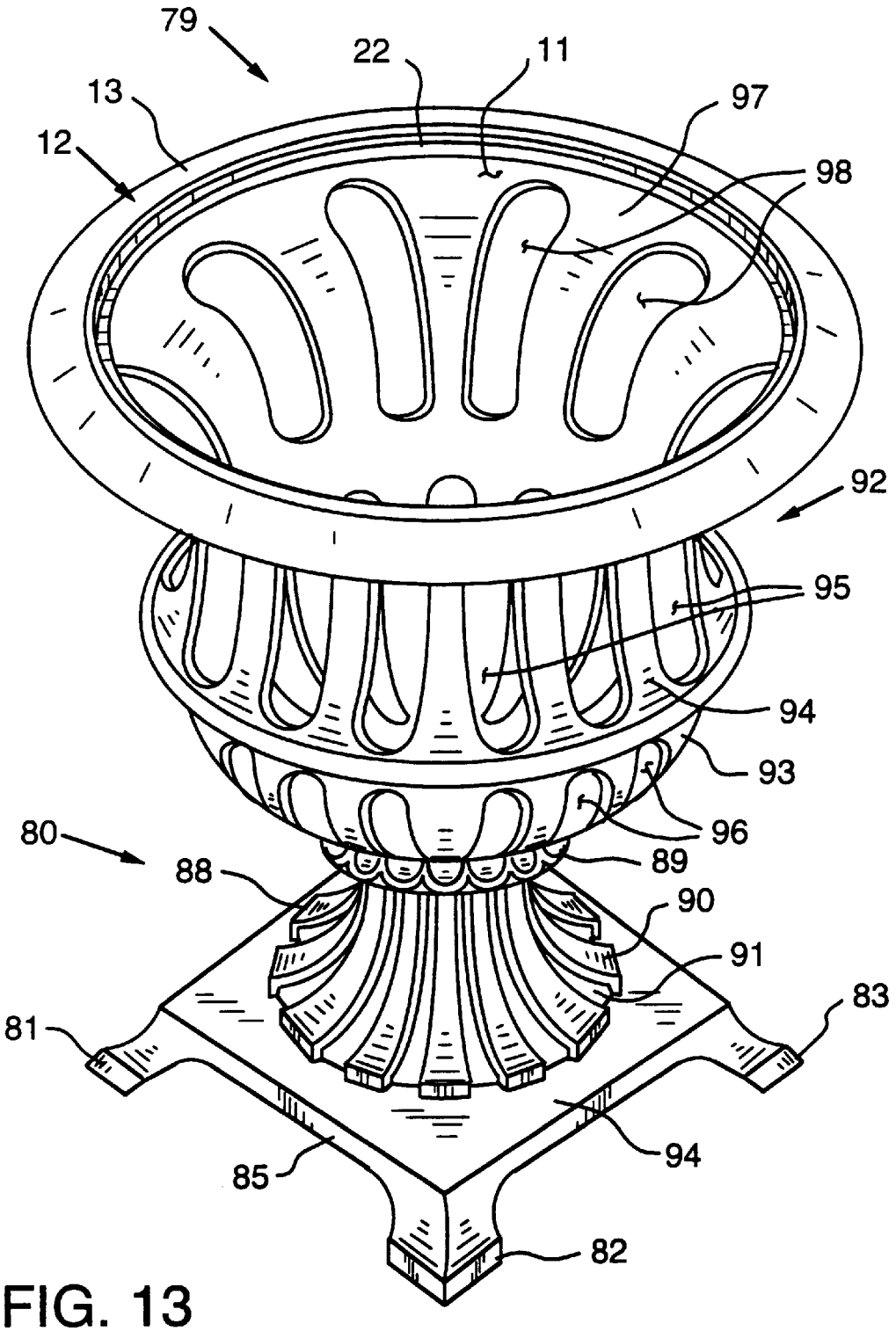
FIG. 13 is a perspective view of an alternate embodiment having the table top insert removed.
Figure 14:
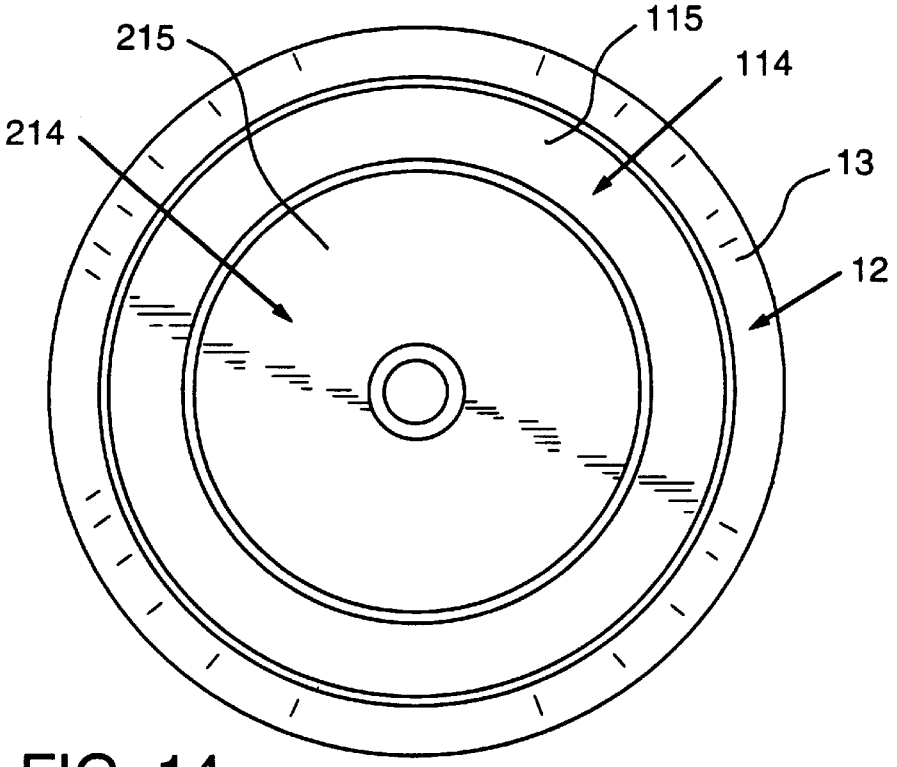
FIG. 14 is a top view of an alternative embodiment.
Figure 15:
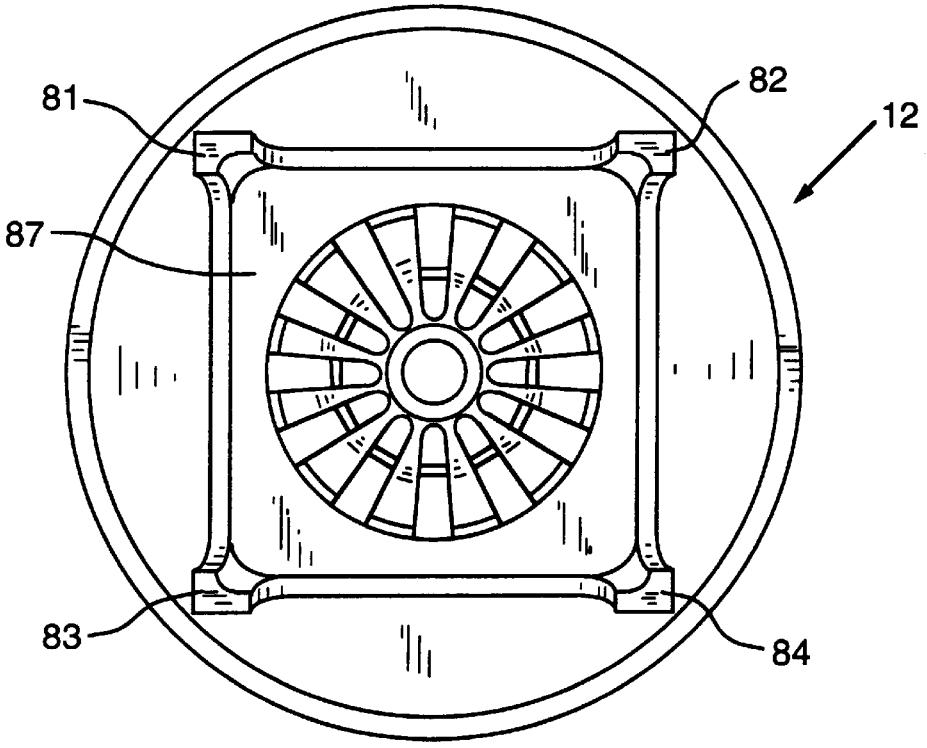
FIG. 15 is a bottom view of an alternative embodiment.
Figure 16:
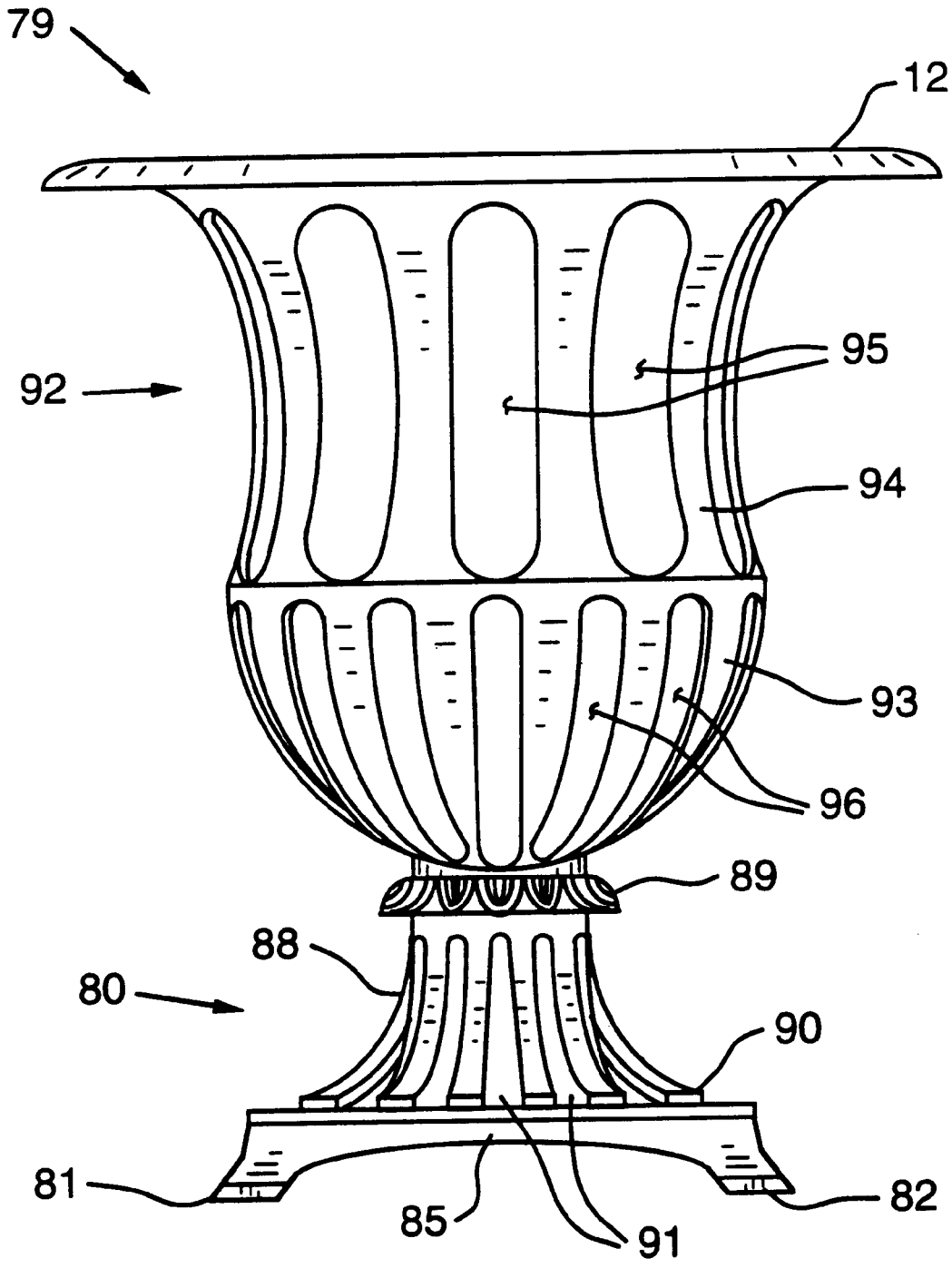
FIG. 16 is a side elevational view of an alternative embodiment.

As shown in FIGS. 11–13, the table top insert 14 may be divided into more than one portion. As shown, the table top insert 14 is divided into a central disk 214 and an annular disk 114. Both the central disk 214 and an annular disk 114 have upper surfaces 215, 115 which are generally planar with each other as well as table top upper surface 13. Annular disk 115 includes a medial opening 111 and an annular flange 122 within the medial opening. Central disk 214 is disposed within opening 111 and rest upon flange 122. Annular disk 115 is disposed within medial opening 11 and rests upon flange 22. Of course, table top insert 14 may be divided in many configurations, e.g. two semi-circular portions.

Figure 3:
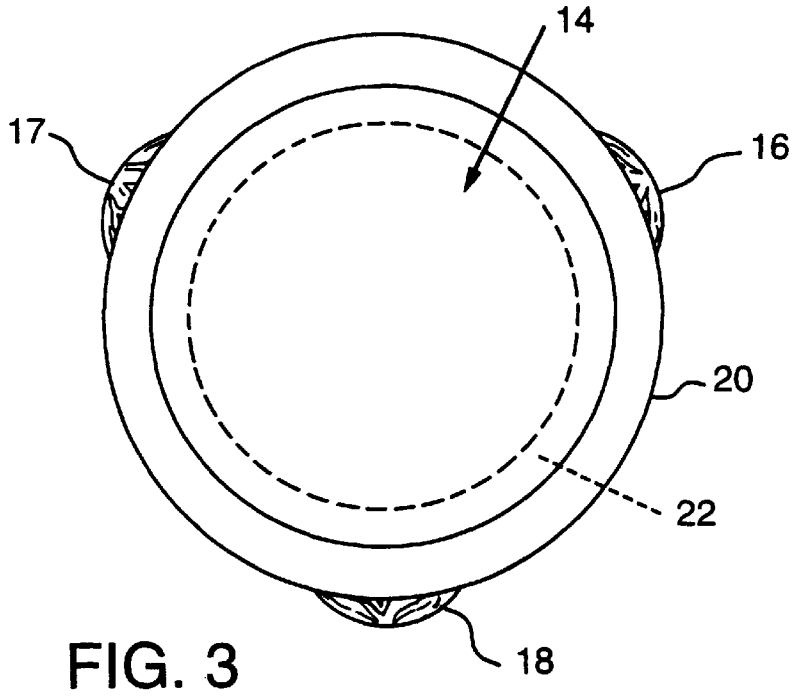
FIG. 3 is a cross-sectional view of the stand taken along line 3—3 of FIG. 2.
Figure 10:
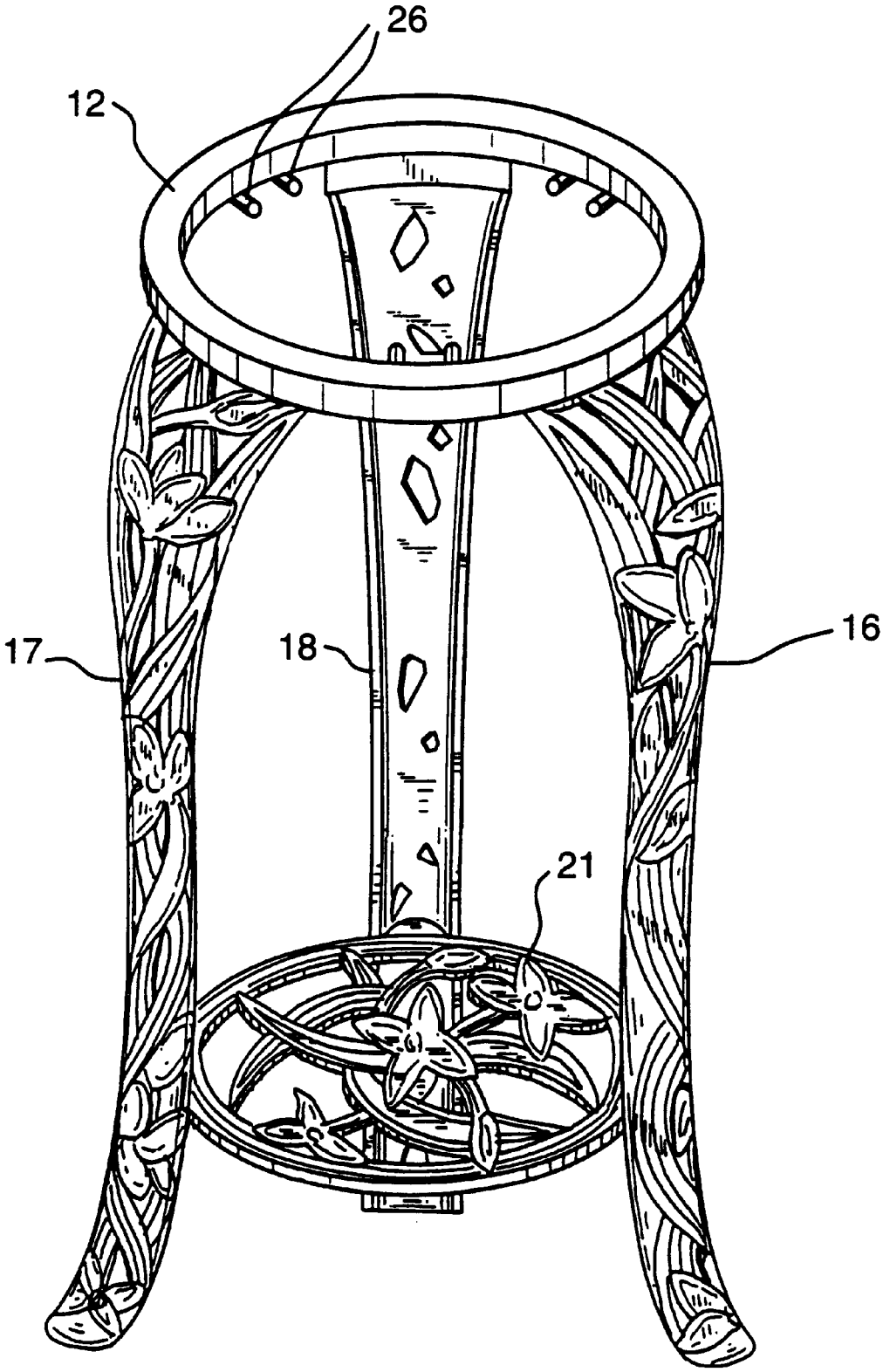
FIG. 10 showing an alternate embodiment with pins attached to lower surface of table top.

Stand 10 provides a means for support for the table top insert 14 so that the table top insert upper surface 15 is maintained in a generally planar position with the table top upper surface 13 when the table top insert 14 is positioned in the medial opening 11. As shown on FIGS. 3, 4*a* and 4*b*, the means for support for the table top insert 14 is located within the opening 11. The means for support can be any common support device such as pins, plates, or any protrusion extending from the table top 12 generally, radially inwardly into the opening 11 so that the table top insert 14 may not pass through the opening 11. Alternatively, as shown on FIG. 10, the means for support, whether pins 26, plates, or a flange, may be attached to the lower surface 20 of the table top.

Figure 4A:
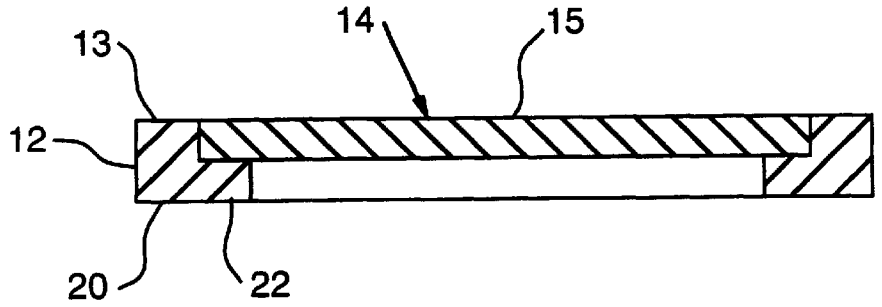
FIGS. 4*a, b* are cross-sectional views taken along line 4—4 of FIG. 2 and FIG. 6.
Figure 4B:
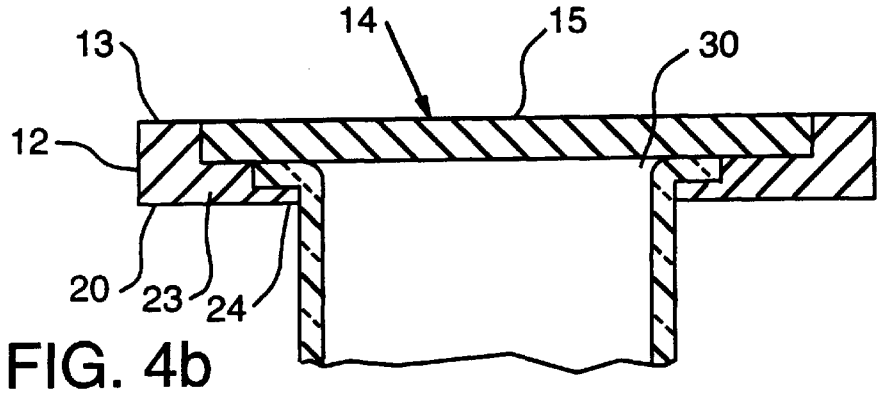

In the preferred embodiment, a portion of the entire circumference of the table top 14 extends generally inwardly into the opening 11 forming a table top flange 22. As shown in FIG. 4*a*, when the table top insert 14 is lowered into the opening 11, the table top insert 14 rests upon the table top flange 22 so that the top insert upper surface 15 is maintained in a generally planar position with the table top upper surface 13. In an alternate embodiment, as shown in FIG. 4*b*, the flange may have a plurality of tiers, e.g. upper tier 23 and lower tier 24. With a plurality of tiers 23, 24 the table top insert 14 as well as a container 30 (described below) may be placed in medial opening 11. In this configuration, the table top insert 14 is sized to rest on the upper tier 23 and the container flange 38 (described below) is sized to rest on the lower flange 23.

Figure 8:
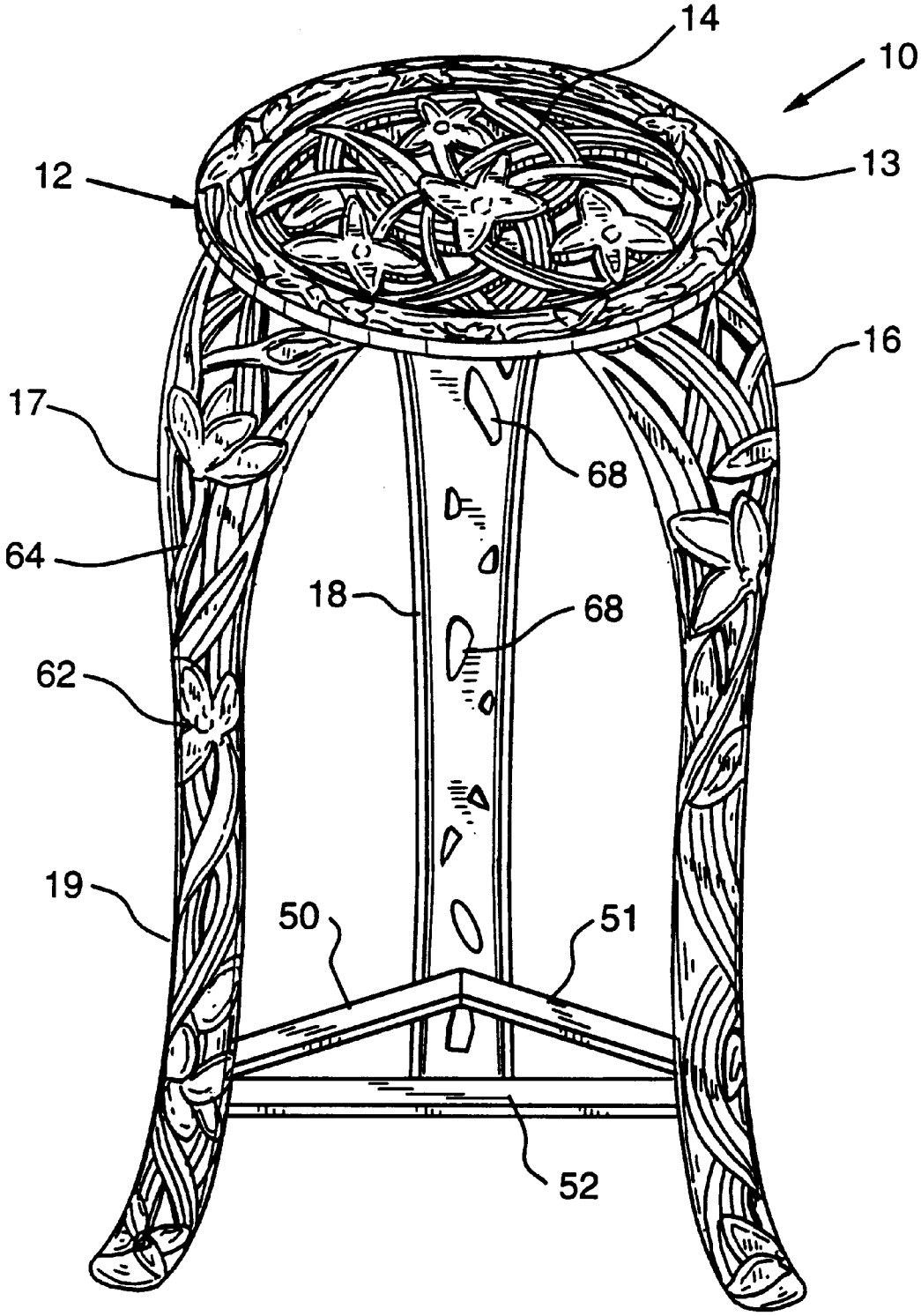
FIG. 8 showing a frame instead of planar brace.

Additionally, in the preferred embodiment, as shown on FIG. 1, there is a brace 21 secured to each lower portion 19 of the leg members 16, 17, 18. This brace 21 may be constructed of a generally planar member, as shown, which may act as an additional support surface below the table top upper surface 12. However, as shown in FIG. 8, the brace may also be constructed of simple frame members 50, 51, 52.

As shown in FIG. 5, the stand is converted into a decorative display by removing the table top insert 14 and installing a container 30 in its place. The container 30 has a body 31, a bottom 32 and an annular sidewall 34 extending upwardly from the bottom 32. The sidewall 34 terminates in an upper edge 36. Along the upper edge 36 a generally, radially, outwardly projecting container flange 38 is formed. The bottom 32 and the sidewalls 34 have a cross-sectional area that is smaller than the cross-sectional area of the opening 11. As such, the container bottom 32 and sidewalls 34 may pass through the opening 11 from above.

Figure 6:
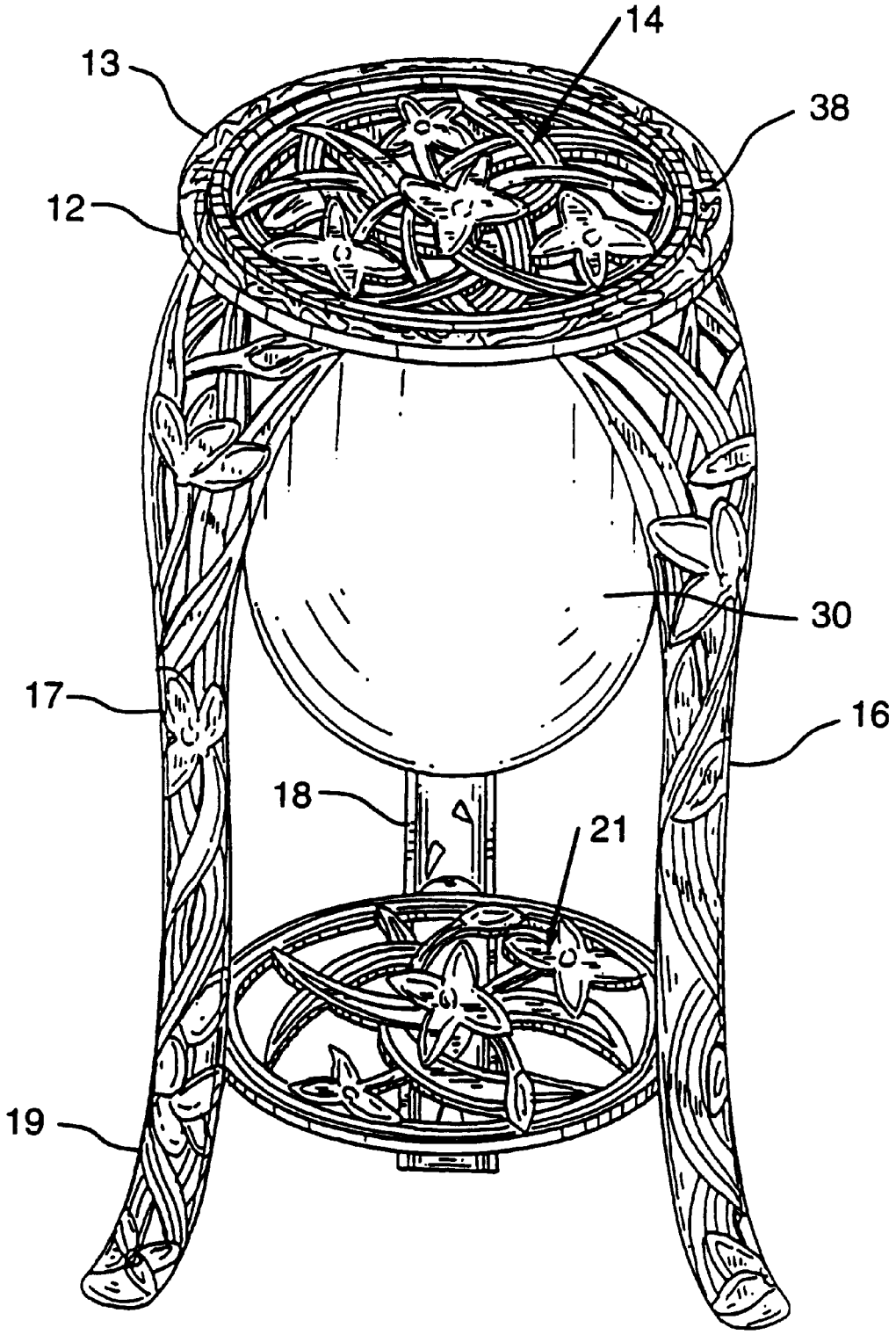
FIG. 6 is a perspective view of the stand with the container inserted and the table top insert positioned on top of the container.

The container flange 38 is sized so that when the container is inserted through the opening 11 from above, the container flange 38 will rest either upon the table top upper surface 12 or the table top insert support means, such as the table top flange 22 of the preferred embodiment. As shown in FIG. 6, in the preferred embodiment, the container flange 38 is sized with a greater cross-sectional area then the opening 11, so that it rests upon the table top upper surface 12. The container flange 38 also has an inner surface 39 (shown on FIG. 5) has the same cross-sectional area as the opening 11. Because the container flange inner surface 39 has the same cross-sectional area as the opening 11, the table top insert 14 may be placed on the container flange inner surface 39.

Figure 7:
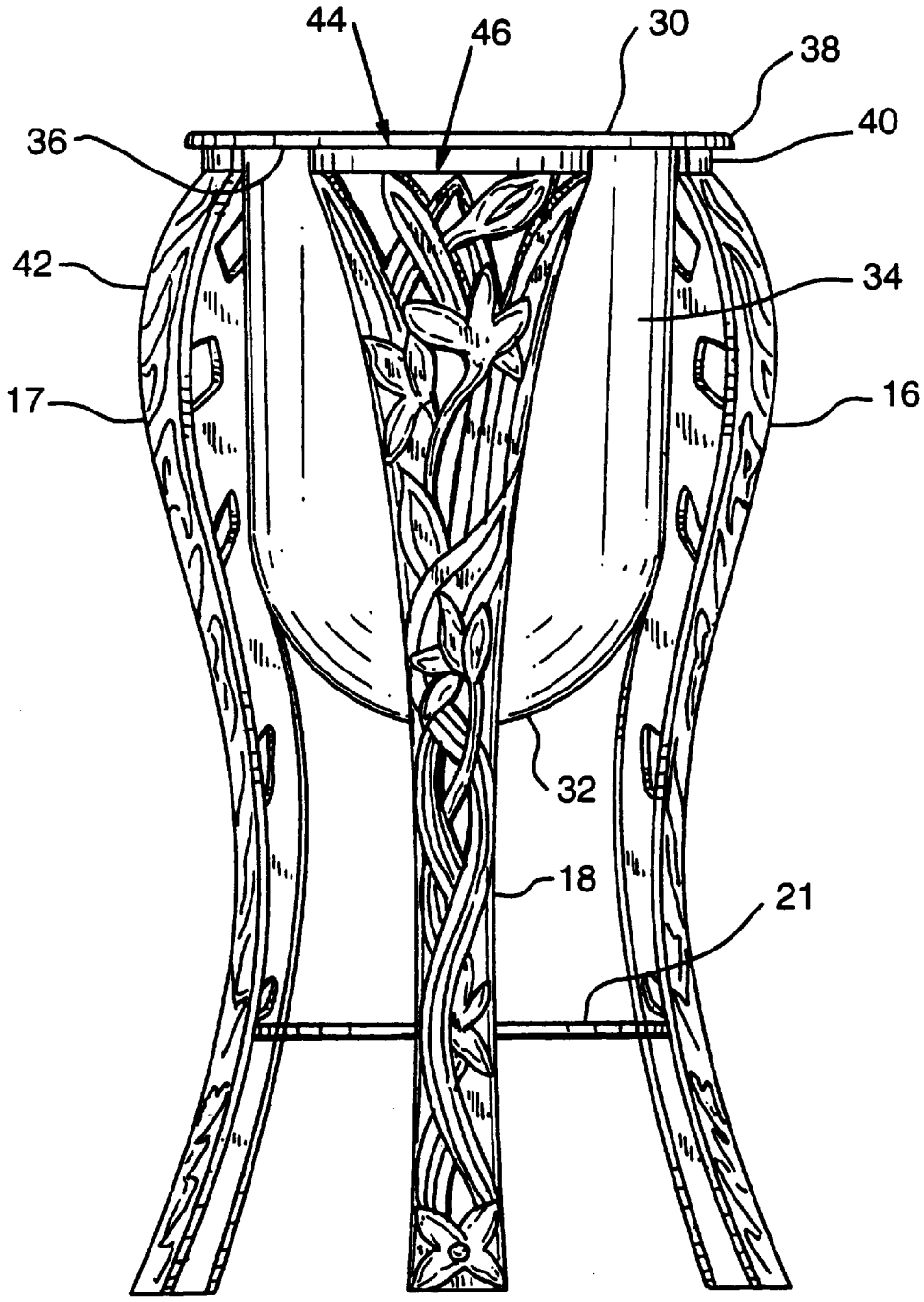
FIG. 7 is an elevational view of a second embodiment of the table with the container inserted.

An alternate embodiment is shown in FIG. 7. In the alternate embodiment, a continuous table top surface does not exist. Instead, each leg member 16, 17, 18 has an upper end 42 which terminates in a generally horizontal planar member 40. The horizontal planar member 40 has an upper portion 44 and a lower portion 46, as well as an interior portion (not shown). The interior portion of the plurality of leg members 16, 17, 18 define an interior space. The leg members are maintained in position by a brace 21 secured near the lower portion of each leg member 19.

Figure 9:
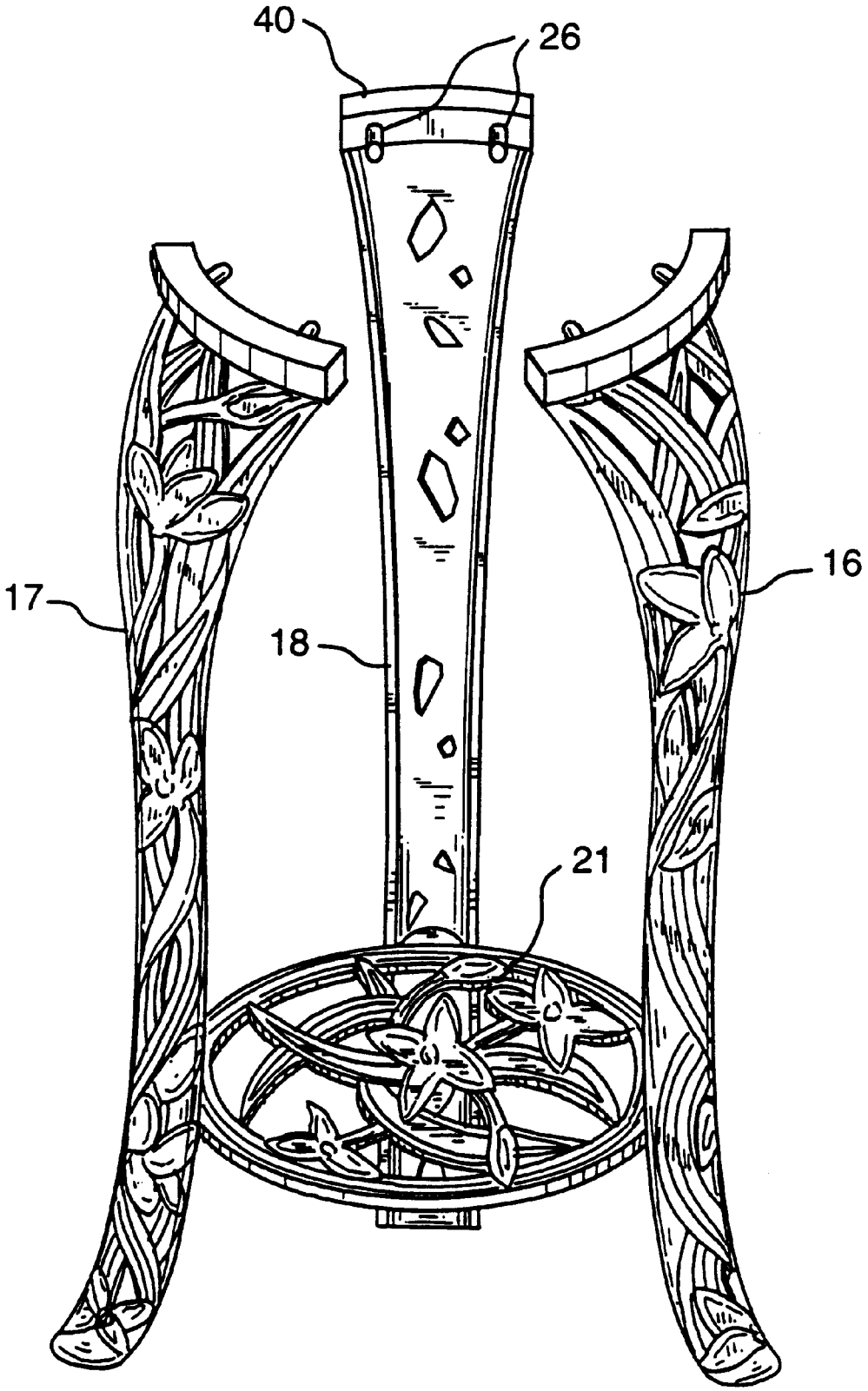
FIG. 9 showing a second embodiment without a container.

Extending from the planar member 40 is a means for supporting the table top insert 14. As shown in FIG. 9, the means for supporting the table top insert could be any type of element, such as pins 26 extending into the interior space so that the table top insert 14 cannot pass through the interior space from above. Of course any other means for supporting the table top insert 14, such as plates or a partial flange, either extending from the planar members or attached to the lower portion 46, could also be used. When lowered into the interior space, the table top insert 14 would rest upon the support means so that the top insert upper surface 15 is maintained in a generally planar position with the planar member upper portion 44.

As with the preferred embodiment, the stand can be converted into a decorative display by removing the table top insert 14 and installing a container 30 in its place. The container 30 has a body 31, a bottom 32 and an annular sidewall 34 extending upwardly from the bottom 32. The sidewall 34 terminates in an upper edge 36 along which the generally, outwardly projecting container flange 38 is formed. The bottom 32 and the sidewall 34 have a cross-sectional area that is smaller than the interior space between the planar surfaces 40. As such, the container bottom 32 and body 31 may pass through the interior space. The container flange 38 is sized with a greater cross-sectional area then the opening 11, so that when the container is inserted through the interior space from above, the container flange 38 will rest either upon the planar surface upper portion 44 or the table top insert support means, such as the pins 26 shown in FIG. 9.

In another alternate embodiment, the stand 10 may be shaped like an urn to 79, as shown in FIGS. 11–16. The urn 79 includes a pedestal portion 80, a bowl shaped body 92 disposed above the pedestal 80. The pedestal 80 includes a planar base member 85 which has an upper surface 86 and a lower surface 87 (shown on FIG. 15). As shown on FIG. 15, a plurality of feet 81, 82, 83, 84 extend downwardly from base member lower surface 87. As shown on FIGS. 11 and 16, Column 88 extends upwardly from base member upper surface 86. Column 88 has a lower end 89 and an upper end 90. Column lower end 90 may be fluted. Column 88 may also have interstices 91 spaced about the column 88.

Body 92 includes a lower portion 93, which is attached to the column upper end 89, and an upper portion 94 which includes table top 12. As shown in FIG. 20 13, the table top 12 has an upper surface 13 and a medial opening therethrough 11. Upper portion 94 and lower portion 93 may each have interstices 95, 96. The interstices 95, 96 allow visual access to the interior of body 92 where a container 30 (not shown) may be placed. As shown in FIG. 13, body 92 may also include inner support member 97. Inner support member 97 may be shaped to match the exterior surface of a container 30 (not shown) which can be inserted in opening 11. The inner support member 97 also includes interstices 98 to allow visual access to the container 30 (not shown).

As shown in FIGS. 11–14, table top insert, shown in two portions as described above, 114, 214 is disposed in medial opening 11. The table top insert upper surface 215, 115 is generally planer with table top upper surface 13. The table top insert 214, 214 may be supported within medial opening 11 by any of the means previously described, e.g., a flange 22, pins (not shown), plates (not shown) or any equivalent thereof.

As depicted most clearly in FIGS. 1 and 5, in the preferred embodiment the table top 12 is circular. And, as depicted most clearly in FIG. 5, the container 30 is also circular, having a bottom 31 which is a hemisphere and a cylindrical body 31. Although the preferred embodiment having a circular table top and a circular opening is depicted in the Figures, those skilled in the art will realize a table top of any shape can be used in conjunction with a medial opening of any shape. For example, the table top may be rectangular and the medial opening could be rectangular or oval. Similarly, a table top could be constructed with more than one opening, e.g., a rectangular table top with two offset circular openings. As defined above, "medial" as used herein does not require the opening to be in the precise middle of the table top. Additionally, those skilled in the art will realize that the stand may have multiple means for supporting the table top insert and container.

As shown in FIG. 1, the table may incorporate a pattern of vegetation formed in relief on the surfaces of the table top 12, table top insert 14, leg members 16, 17, 18 and brace 18. The pattern of vegetation may include flowers 62, stems 64, and buds 66. Cutouts 68 may be used as required to effect the pattern. The stand can be constructed of any common materials such as plastic or wood, however, metal is preferred.

The invention as described above may have additional uses other than as a planter. For example, if the container 30 were composed of glass or a clear plastic, the container 30 could be used to display any decorative object, such as artificial flowers, a candle or colorful bulbs. Any such alternative use is contemplated by the present invention.

While certain embodiments of the invention have been described herein for the purposes of illustration, it will be evident to those skilled in the art that numerous variations of the details may be made without departing from the invention described in the following claims.

What is claimed is:

1. A stand comprising:

a table top having an upper surface and an opening therethrough;

a container having a container body defining a cavity therein and an upper, generally, outwardly projecting flange, said container body having a smaller cross-sectional area than said opening;

said container disposed in said opening;

a plurality of leg members depending from said table top;

a removable table top insert having an upper surface;

said table top insert being disposed within said opening such that said upper surface of the table top insert is generally planar with said upper surface of said table top.

2. The stand according to claim 1 wherein the table top has a table top insert supporting means.

3. The stand according to claim 2 wherein said table top insert supporting means is an annular flange extending from said table top into said opening.

4. The stand according to claim 1 wherein said table top insert is divided into more than one portion.

5. The stand according to claim 4 wherein said table top insert includes a central disk portion and an annular disk portion;

said annular disk portion having a flange sized to support said central disk.

6. The stand according to claim 2 wherein said container has a bottom, sidewalls extending circumferentially and upward from said bottom and terminating in said upper edge, forming a cavity therein, and said flange is disposed on said upper edge of the sidewalls.

7. The stand according to claim 6 wherein said container flange is generally the same size as said table top insert.

8. The stand according to claim 6 wherein said container flange is larger than the opening and said flange has an inner surface with the same cross-sectional area as the opening through said table top upper surface.

9. The stand according to claim 6 wherein said table top insert supporting means is flange having at least two tiers;

said table top insert resting on an upper tier; and said container flange resting on a lower tier.

10. The stand according to claim 6 wherein said container body is generally cylindrical and said bottom is of a generally hemispherical shape.

11. The stand according to claim 2 wherein said plurality of leg members each have an upper portion and a lower portion and wherein said upper portion of each leg member is attached to said table top and where a brace for supporting said leg members is attached to each leg member lower portion.

12. The stand according to claim 11 wherein the brace for supporting said leg members is a generally planar member.

13. The stand according to claim 11 wherein the brace for supporting said leg members is a plurality of frame members.

* * * * *

UNITED STATES PATENT AND TRADEMARK OFFICE

CERTIFICATE OF CORRECTION

PATENT NO. : 6,237,508 B1
DATED : May 29, 2001
INVENTOR(S) : Jeffry Weiss

It is certified that error appears in the above-identified patent and that said Letters Patent is hereby corrected as shown below:

Title page,
FOREIGN PATENT DOCUMENTS, -- 2,713,124 1/1993 -- should be inserted.

Column 1,
Line 19, "to" should be deleted.

Column 5,
Line 43, "20"" should be deleted.

Signed and Sealed this

Ninth Day of July, 2002

*Attest:*

*Attesting Officer*

JAMES E. ROGAN
*Director of the United States Patent and Trademark Office*